US009330559B1

(12) United States Patent
Ryan

(10) Patent No.: US 9,330,559 B1
(45) Date of Patent: May 3, 2016

(54) SYSTEM AND METHOD FOR ALARM EXTENSION

(71) Applicant: Gerald P. Ryan, Geneva, IL (US)

(72) Inventor: Gerald P. Ryan, Geneva, IL (US)

( * ) Notice: Subject to any disclaimer, the term of this patent is extended or adjusted under 35 U.S.C. 154(b) by 58 days.

(21) Appl. No.: 14/242,710

(22) Filed: Apr. 1, 2014

(51) Int. Cl.
*G08B 23/00* (2006.01)
*G08B 25/10* (2006.01)

(52) U.S. Cl.
CPC ..... *G08B 25/10* (2013.01)

(58) Field of Classification Search
CPC ..... G08B 17/10; G08B 25/00; G08B 25/009; G08B 27/003
USPC ..... 340/501, 506, 534, 628, 632, 13.24, 340/815.4
See application file for complete search history.

(56) References Cited

U.S. PATENT DOCUMENTS

| | | | | |
|---|---|---|---|---|
| 4,612,535 | A * | 9/1986 | Sequin et al. | 340/539.26 |
| 4,996,517 | A * | 2/1991 | Kringen et al. | 340/506 |
| 5,177,461 | A * | 1/1993 | Budzyna et al. | 340/331 |
| 5,745,040 | A * | 4/1998 | Loughridge | 340/628 |
| 6,114,948 | A * | 9/2000 | Astell | 340/332 |
| 6,222,455 | B1 * | 4/2001 | Kaiser | 340/628 |
| 6,690,288 | B1 * | 2/2004 | Waddell | 340/692 |
| 2013/0002440 | A1 * | 1/2013 | Crossman et al. | 340/628 |

* cited by examiner

*Primary Examiner* — Phung Nguyen
(74) *Attorney, Agent, or Firm* — Clifford H. Kraft

(57) ABSTRACT

An alarm extension system that takes an interior alarm condition and extends it to the exterior of a structure. In various embodiments, the present invention is a system and method that links to an existing alarm (smoke detector, burglar alarm, etc.) and activates a flashing mode in one or more exterior lights or an exterior siren. Thus, during an alarm condition within the house or other structure, a neighbor or anyone passing by can become aware of the alarm condition. This method of signaling thus alerts many in the surrounding area of a situation within the building that may require emergency assistance.

21 Claims, 4 Drawing Sheets

SYSTEM AND METHOD FOR ALARM EXTENSION

BACKGROUND

1. Field of the Invention

The present invention relates generally to alarm systems and more particularly to a system and method where any activation of an existing alarm system inside a structure can be relayed to an external unit that can flash or provide an audio alert of the internal alarm condition.

2. Description of the Prior Art

Numerous alarm and emergency indications systems are known in the art. Examples include burglar alarms, smoke detectors, carbon monoxide detectors, natural gas detectors and many other alarms or safety devices.

While some burglar alarms have exterior flashers or sirens, most do not. Most smoke detectors and carbon monoxide or other gas detectors are totally interior. It would be very advantageous to have a device that acted as an extension of an existing alarm device to indicate on the exterior of a structure that there is a problem within.

SUMMARY OF THE INVENTION

The present invention is related to an extension system that takes an interior alarm condition and extends it to the exterior of a structure. In various embodiments, the present invention is a system and method that links to an existing alarm (smoke detector, burglar alarm, etc.) and activates a flashing mode in one or more exterior lights or an exterior siren. Thus, during an alarm condition within the house or other structure, a neighbor or anyone passing by can become aware of the alarm condition. This signaling alerts people in the surrounding area of a situation within the building that may require emergency assistance.

The preferred embodiment includes two units, an alarm detection or trigger unit, and a remote receiver light unit. The trigger unit detects an alarm by sensing an audio signal, a light signal or any other signal from the existing alarm. Typically, the trigger unit is not directly coupled to the alarm. Warranties and contracts on many burglar alarm systems prohibit direct connection. Smoke alarms are generally test laboratory approved and also cannot be tapped into. The trigger unit therefore picks up a light signal or an audio alarm from the interior alarm unit. Upon detection of an alarm condition, the trigger unit sends a coded signal to the remote receiver. This is done using a wireless technique such as RF. The remote receiver is normally located on the exterior of the structure; however, it can also be located in a window or other convenient place where it can signal to the outside world. Upon receiving the correct coded signal, the receiver unit activates and causes lights to flash along with an optional audio signal.

DESCRIPTION OF THE FIGURES

Attention is now directed to several drawings that illustrate features of the present invention.

Several illustrations have been provided to aid in understanding the present invention. The scope of the present invention is not limited to what is shown in the figures.

DETAILED DESCRIPTION OF THE INVENTION

The present invention relates to a system for extending an internal alarm from inside a structure to the outside so that neighbors or passersby become aware of a problem inside the structure.

Figure 1:
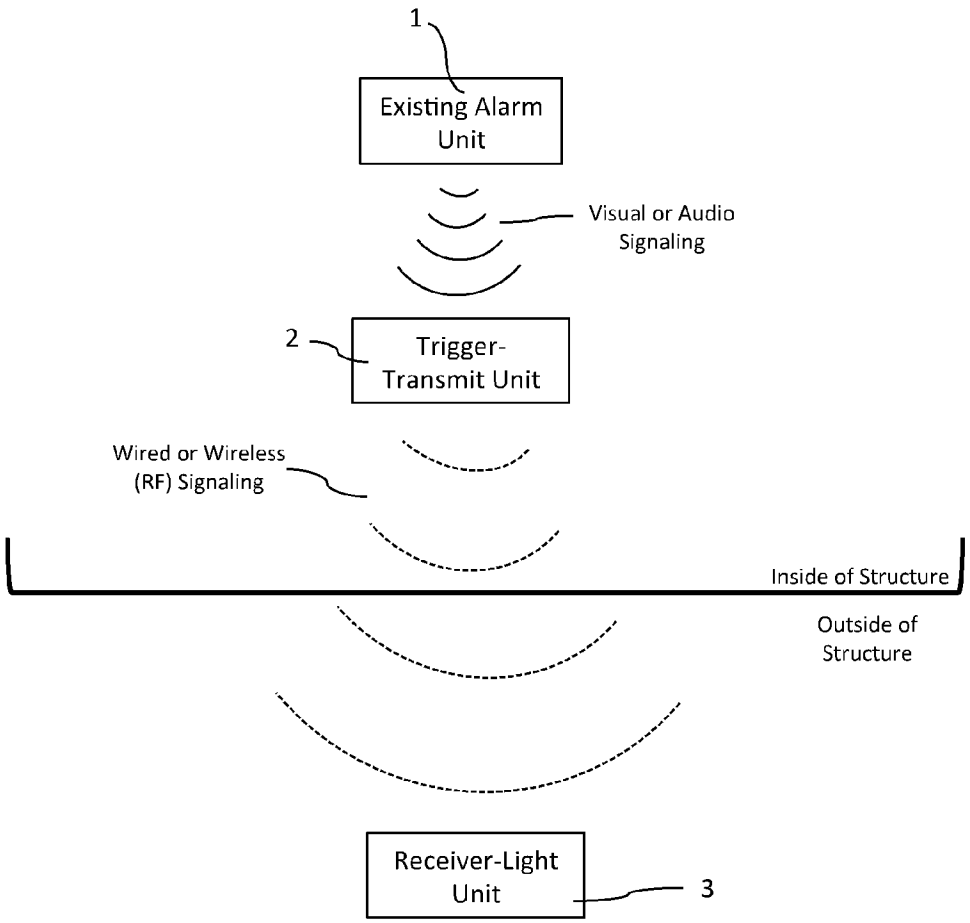
FIG. 1 is a block diagram of the preferred embodiment.

The system includes at least two units: 1) an alarm detection trigger unit, and 2) a remote receiver and annunciator unit. FIG. 1 shows a block diagram of the preferred embodiment. An existing alarm 1 such as a smoke alarm puts out either a visual or audio signal when it detects a dangerous condition. The trigger unit 2 of the present invention detects this alarm. In the case of a smoke alarm, this can be accomplished using a miniature microphone. Electronic circuits can filter and measure amplitude of detected sound to prevent false alarms. The trigger unit 2 can signal wirelessly to a receiver unit 3 typically located on the exterior of the structure. This unit can flash or produce an external audio signal when the trigger unit has detected an alarm. A photocell or other photo detector can be used on the trigger unit 2 to detect flashing alarm lights.

Trigger-Transmit Unit (T-Tx Unit)

There can be any number of embodiments of the trigger unit 2. At a minimum, the unit needs power (A/C and/or battery), a method to detect an external alarm condition, and a code transmitter. If a/c powered, a battery backup can be used. The unit can also include a rechargeable battery.

The trigger unit may be located right next to, or at least near, the alarm source. For instance, in the case of an extension to a smoke alarm, the trigger unit case can be attached to the ceiling very near the smoke detector. In fact, the trigger unit can even be secured to the smoke detector itself through the use of a clamp. The trigger unit can optionally secure to an existing light socket by having a male light socket adapter as its securing mechanism.

If the alarm is an audible type, an audio detection method is used for the trigger unit. The audio detection electronics can have a simple amplitude range setting that ignores lower level sound thresholds so that the user is less likely to accidentally set off the alarm.

In addition, the audio detection system could implement a time integration of the received audio input. The method of time integration could be either a simple analog type or a digital type. The analog type could employ a very simple op amp integrator and comparator. For digital integration, detected audio signals exceeding the predetermined amplitude threshold would cause a timer to initiate. The received audio can then be analyzed over the specified time window to determine the amount of time, as a percentage, as having the amplitude threshold exceeded. An alarm condition can thus be required to satisfy the amplitude threshold over a prescribed percentage of any received time span. This would then allow for the filtering (and thus ignoring) of any high level noise of short duration (e.g. a barking dog).

A more sophisticated trigger detection method can implement the use of an audio training mode, which could be used to "learn" the alarm signal. This signal can be stored within the unit and used as a match for the incoming audio activation. This method could provide enhanced trigger detection while limiting spurious alarm activation. Also, simple filtering can be used to eliminate lower frequencies such as voices, bumps, footsteps and the like. Optionally, the trigger unit can be wired directly to an alarm activation lead (used to tie all of the alarms in the dwelling together) or directly to a particular alarm.

The trigger unit can have a unique activation code that can be set by the user or set at the factory. This activation code set on the trigger unit would need to be matched to the code set within the receiver light unit. The activation code can range from a simple sequence of coded numbers from a switch to an advanced rolling code such as that used in some garage door openers. The code can be modulated onto an RF or light carrier or transmitted over power lines using pulse width, pulse amplitude, pulse position modulation, phase modulation or any other modulation technique. In particular, the code can be binary, ternary or based on any other number system. The reason for the activation code is to prevent nearby similar units from different buildings from triggering the receiver unit.

To further enhance the reliability of the trigger mechanism, the present invention can include a redundancy of the trigger hardware. For example, two trigger units can be installed side be side in any one location. This provides 2N redundancy, and thus far greater reliability.

Trigger-Transmit Unit Input/Output

Trigger-Transmit Unit I/O can include any, all or none of the following:

Audio Alarm.

The Audio Alarm on the T-Tx Unit can indicate any number of conditions such as but not limited to: the triggering of the trigger unit itself, low battery indication, a received alarm condition in any of the alarm extension units, or a tampering condition in any of the alarm extension units.

Unit Disable.

By default, a powered T-Tx unit is on. But occasionally, the user may want to disable the T-Tx Unit. This can be useful during periods of unavoidable noise, such as while vacuuming or when power tools are being used. The audio detection disable can be an on/off button or a button that activates a disable timer. The disable timer causes a temporary disabling of the trigger unit; thus eliminating the possibility of a user forgetting to turn the trigger unit back on.

Alarm Amplitude Threshold Setting.

This feature sets the audio amplitude sensitivity of the T-Tx Unit. This can be either a knob or a push button type. The push button type can walk the audio amplitude trigger sensitivity though a set of discrete levels.

Alarm Duration Threshold Setting.

This feature sets the required duration, or time occupancy threshold, of the audio trigger. This can be either a knob or a push button type. The push button type walks the audio duration requirement though a set of discrete levels.

Alarm Pitch/Frequency Cutoff Setting.

This feature sets the pitch, or frequency cutoff of the audio trigger. This can be either a knob or a push button type. The push button type walks the audio pitch/frequency cutoff setting though a set of discrete levels.

Alarm Learn Button.

The Alarm Learn button can be used to put the unit in an optional Alarm Learning Mode. The user first causes the existing alarm unit (smoke, CO or other installed detector), to activate perhaps via the test button on the existing alarm. Once the existing alarm is sounding, the user then presses the Alarm Learn Button to activate learning. It can be required that the Alarm Learn Button be held for a learning duration, that the Alarm Learn Button be pressed once to start learning, and a second time to stop learning. Any sequence of button interaction can be used to initiate, sustain and disengage the Alarm Learn Mode.

Tamper Proof Mode Engage Button.

The Tamper Proof Mode Engage Button causes the Trigger-Transmit Unit to send a coded transmission to the Receiver-Light Unit to engage the tamper proof mode within the Receiver-Light Unit. The tamper proof mode is typically engaged only after a test has been run to ensure that the Trigger-Transmit Unit and the Receiver-Light Unit are functioning as a pair.

Factory Reset Button.

The Factory Reset Button returns all of the device settings back to the factory default mode.

Shared LED Bank/Numeric User Setting and Mode Indication.

The Shared LED Bank/Numeric User Setting Indicator can be used to indicate the level of any particular user setting. As the user is setting a particular control attribute, the number of LEDs illuminated can increase or decrease based upon the setting. The LED Bank can start to flash once the desired device setting is activated (via the control knob, control button or other). Once flashing, the user knows that the parameter control setting is active. As the knob is turned, or the increase/decrease button is depressed, additional LEDs illuminate or turn off to indicate the setting. If a numeric indicator is used, the current setting number can be adjusted in a like manner. In addition, the Shared LED Bank/Numeric Indicator can be used to indicate the mode of operation, a successful reception of a "Learned Alarm" or can provide for any number of diagnostic indications, such as but not limited to, normal operation, low battery indication or tamper mode detection.

Ethernet Interface.

The T-Tx Unit can have a wired (E-Net, Fiber etc.) or wireless (cellular, 802.11, etc.) Internet connection.

Generic Electronic Interface.

The T-Tx Unit can have any form of electronic interface such as RS-232, USB, FireWire, IR, and the like. Such an interface is useful to upgrade or configure the unit, or to download any diagnostic or alarm data stored within the unit.

Additional I/O.

Any other T-Tx Unit interfaces not specifically mentioned herein, but required to accomplish any function covered in the body of this document are within the scope of the present invention.

Figure 2:
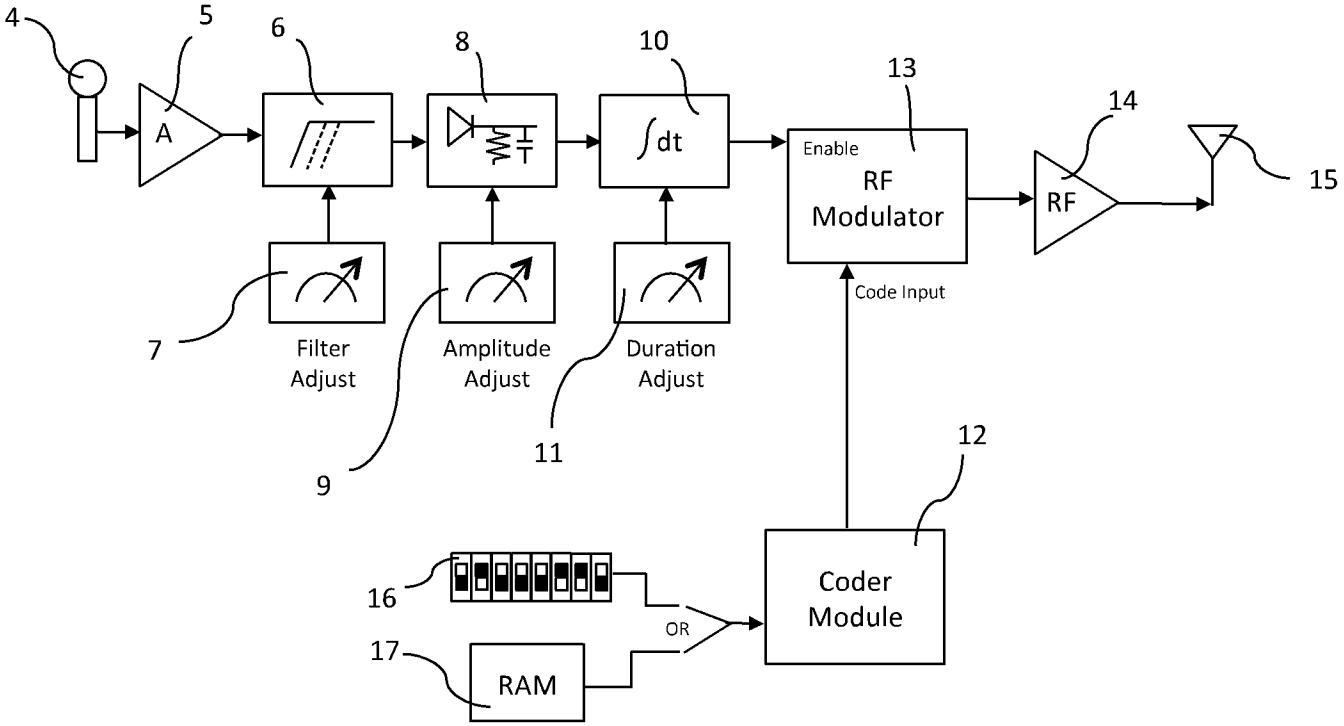
FIG. 2 shows block diagram of the trigger unit.

FIG. 2 shows a block diagram of an example embodiment of a trigger unit. A microphone 4, feeds an audio amplifier 5 that drives an audio filter 6. The audio filter 6 can be a highpass or bandpass filter that is designed according to methods known in the art to only detect the desired frequency (pitch) of an audio alarm such as that from a smoke alarm. The audio filter 6 is optionally configured by frequency setting adjust 7. An amplitude detector 8 sets a threshold on amplitude optionally configured by amplitude setting adjust 9 so that only very loud signals pass. Time integrator 10 can further eliminate audio signals that do not satisfy the time duration requirement configured by the duration setting adjust 11. A transmit coder module 12 creates the digital activation code and feeds it sequentially to the RF modulator 13. The RF modulator 13 modulates the code on a wireless carrier in a non-licensed user RF band and feeds it to a power amplifier 14 which drives an antenna 15. Alternatively, wireless transmission by light can be used. Typically the transmit coder keeps repeating the code as long as the alarm is detected; however, it can be designed to only repeat a fixed number of times. The digital activation code can be optionally selected using switches 16 or stored in a memory 17.

The embodiment shown in FIG. 2 is mostly analog using well-known op-amps or the like for the audio amplifier 5, the filter 6 and the amplitude detector 8. However, as is well-known in the art, an ND converter may be used followed by more sophisticated digital filtering or digital signal processing. This processing can be optionally performed using a digital signal processor DSP chip known in the art. This more sophisticated processing can be used for units with leaning modes and the like. Any type of analog or digital processing or any combination of analog and digital circuitry is within the scope of the present invention. While the example of FIG. 2 uses filtering, amplitude and duration thresholding, any conditioning type may be used alone. The example of FIG. 2 detects audio. As has been discussed, a trigger unit can also be made to detect a flashing light or any other alarm signal.

Receiver-Light Unit (Rx-L Unit)

There can also be a number of embodiments of the receiver light unit. At a minimum, the unit needs power (a/c and or battery), a light, LED or a fixture for a light, and a code receiver. Additionally, if the unit is mounted outdoors, it needs some protection or weatherproofing.

The receiver light unit can optionally secure to an existing light socket by having a male light socket adapter as its securing mechanism. The receiver light unit can simply be screwed into the fixture. The receiver light unit can then optionally have it's own socket into which a standard type of a light bulb or CFL could be secured. If a/c powered, a battery backup can be used. The unit can also include a rechargeable battery.

The receiver light unit may also just be a stand alone unit that is only battery powered. With the present availability of high intensity LED lighting, a long lasting battery powered unit can attached to any exterior location. To keep the unit out of reach of those attempting to tamper with the unit, the unit can be attached just outside of a window. LEDs and modern integrated circuits are not heavy, hence, the receiver light unit can be optionally secured to the exterior of the structure with an adhesive bond or strap.

Receiver-Light Unit Input/Output

The Receiver-Light Unit I/O can include any, all or none of the following:

Audio Alarm.

The Audio Alarm on the Rx-L Unit can indicate any number of things such as but not limited to: a triggered alarm, low battery indication, or a tampering condition.

Unit Disable.

By default, the Rx-L unit is on. But occasionally, the user may want to disable the Rx-L Unit. This can be useful during a power outage or when the alarm extension system is being configured. The Rx-L Unit disable can be an on/off button or a button that activates a disable timer. The disable timer causes a temporary disabling of the trigger unit; thus eliminating the possibility of a user forgetting to turn the trigger unit back on.

Ethernet Interface.

The Rx-L Unit can have a wired (E-Net, Fiber etc.) or wireless (cellular, 802.11, etc.) Internet connection.

Generic Electronic Interface.

The Rx-L Unit can have any form of electronic interface such as RS-232, USB, FireWire, IR, and the like. Such an interface is useful to upgrade or configure the unit, or to download any diagnostic or alarm capture data stored within the unit.

Additional I/O.

Any other Rx-L Unit interfaces not specifically mentioned herein, but required to accomplish any function covered in the body of this document is within the scope of the present invention.

Figure 3:
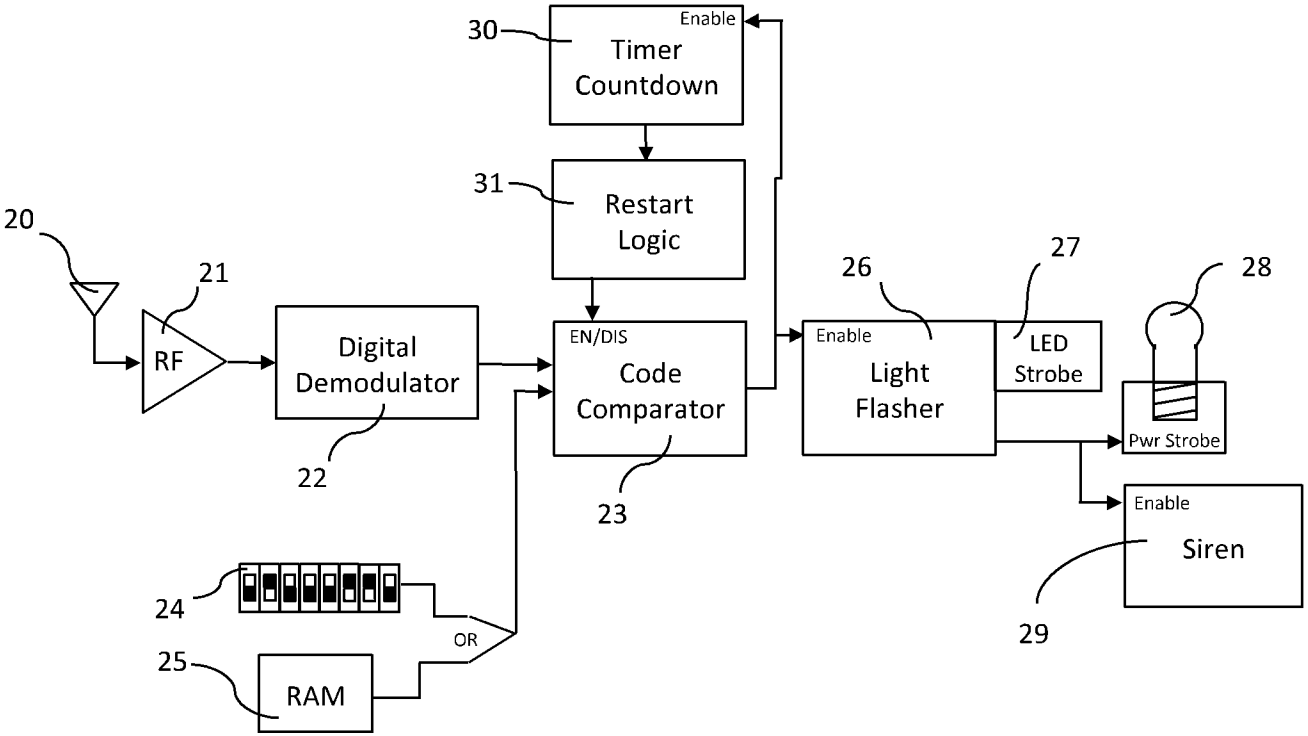
FIG. 3 shows a block diagram of the receiver unit.

FIG. 3 shows a block diagram of an example embodiment of a receiver light unit. A receive antenna 20 feeds an RF amplifier 21 that drives a digital demodulator 22. The digital demodulator 22 recovers the digital activation code, which was modulated onto the RF carrier by the trigger unit. A code comparator module 23 compares the received activation code with a stored version of the code to determine an activation. The stored version can be stored on switches 24 or in an optional memory 25 as is known in the art. Upon activation, a light flasher module 26 causes a set of LED lights 27 or other lights 28 to flash, and optionally an audio source 29 such as a siren to activate. One method of operating the receiver light unit is to flash as long as the activation code is continuously received from the trigger unit. A second method is to only operate for a particular timed duration. After a timeout, a check could be made to see if the activation code was still being received. If so, another timed interval can be started. In this case, an optional timer 30 and logic circuit 31 can be used.

Figure 4:
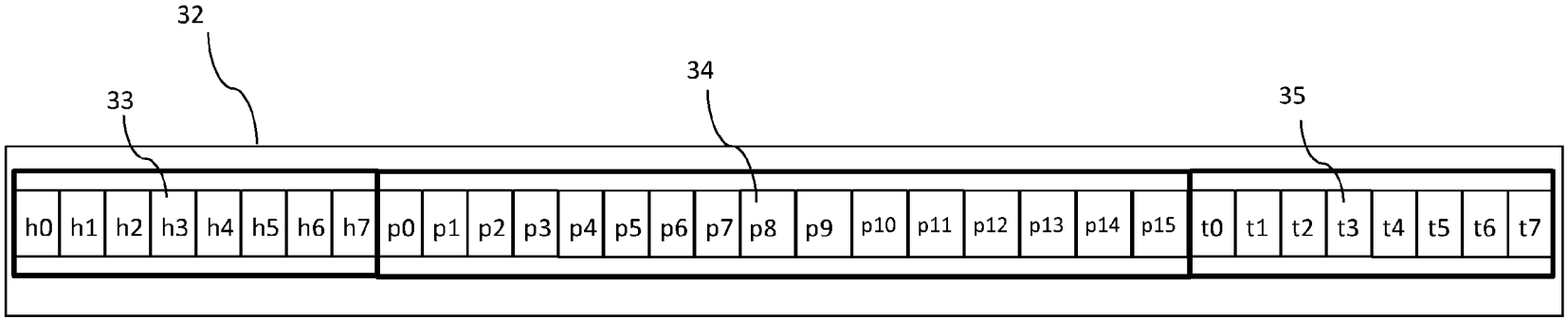
FIG. 4 shows a possible coded message format.

The receiver light unit has the ability to receive the activation code sent from the trigger unit. As stated, the path for transmission can be an RF link, over power lines, by light path (possibly infrared) or by any other method used to link a transmitter to a receiver. FIG. 4 shows a sample activation code "packet" that can be sent from the trigger unit. The packet 32 can have a header 33 used to synchronize the digital demodulator 22 and the code comparator 23. The header can consist of a repeating number of fixed digits or fixed pulses from the RF unit. After the header 33 is the payload 34 that contains the activation code. To avoid transmission errors, the payload 34 can optionally be repeated several times in the packet such as three times. The code comparator 23 can be programmed to accept any good code that comes in, or be required to receive at least two out of three good codes or the like to improve noise performance if the remote unit is located far from the trigger unit. Finally, the packet can have an optional trailer 35. This can be a series of digits that signal the end of the packet and allow both the transmitter and receiver to shut down.

Additional Components

Panic Button

One or more "panic buttons" can be placed within the house. The panic button can be a manually operated trigger unit. In the event that the individual is under duress, that person can manually activate the panic button which in turn sends the alarm activation to the receiver light unit. In addition, a user can keep a panic button on their person. Thus in a situation where there is a medical or other type emergency, the person under duress could access the trigger transmit unit. The panic button could be in the form of a dongle that is worn or otherwise. It can be a trigger transmitter unit itself, or it can communicate with a trigger transmitter unit via a second wireless link.

Security

The trigger transmit unit transmits a unique code to the receiver light unit. As discussed, this prevents activation of an alarm mode by another, closely located trigger transmit unit or by a stray RF or light signal. The code can be made highly secure if desired using encryption such as rolling encryption algorithms used in some garage door openers. However, for typical use in a house, an unencrypted code is usually sufficient. The activation code encrypted or not can roll as is known in the art, or simply be a fixed set of digits.

Tamper Proofing

There can be a mode that is only initiated by the trigger transmit unit where the receiver light unit, once securely in place, is put into a tamper proof state. If a tamper condition is detected, a high intensity audible alarm can be activated within the receiver light unit. The receiver light unit can also send a tamper notification back to the trigger transmit unit. This serves to call attention to the attempted interruption in the system. Such tamper detection within the receiver light unit can be accomplished in a number of ways. An accelerometer can be engaged by the trigger transmit unit, or the unit can be sealed with one or more tamper switches. Alternatively, the tamper mode could detect an a/c power loss. Any a/c power interruption by the trigger unit can be sent to the receiver light unit thereby disabling the a/c tamper mode during an a/c power failure.

Control of Pre-Existing Lights

Typically, a flashing light on the Receiver-Light indicates an alarm condition. However, the Rx-L Unit often requires control of the static light condition (ON or OFF). In cases where the Receiver Light Unit installs in series with an existing light fixture, it is desired to leave the power to the pre-existing light fixture ON at all times so that the unit is charging and not running off of the battery. For this reason, the light switch to power the light fixture should always be ON. At the same time, control of the pre-existing light is necessary. Many methods may be used to control the "ON/OFF" condition of the pre-existing light fixture while still having the ON/OFF switch remain ON during the steady state condition. One method to control the pre-existing light fixture is employs the use of power toggling. A simple toggling of the ON/OFF switch from ON to OFF and then back to ON (ON→OFF→ON) changes the ON/OFF state of the light. In such an embodiment, any time that the Rx-L Unit looses power momentarily, the power passed to the light toggles from OFF to ON or visa-versa. Of course, multiple ON/OFF transitions can also be used to change the static light condition. Finally, a remote control (IR or RF) or any other means not specified here can be used to control the static light condition on the Rx-L Unit.

Feedback from Rx-L to T-Tx

As mentioned, the T-Tx Unit likely resides within the residence. Therefore, it is beneficial to feedback diagnostic information from the Rx-L Unit installed outside the building to the T-Tx Unit within the building. Thus, individuals within the building can become aware of any important status information regarding the Rx-L Unit. As mentioned, tamper indication can be fed back to the T-Tx Unit. Another example of pertinent feedback pertains to the simple loss of NC power, which occurs if a user inadvertently turns OFF the power to an external light fixture housing a Rx-L unit. In this case, a notification can be sent back from Rx-L to T-Tx perhaps causing a chirp sequence to sound on the alarm located on the T-Tx Unit.

Extension to the Internet

The alarm extension system can include an extension to the Internet. In this case, any alarm, which is picked up by the Trigger-Transmit Unit, is forwarded, via the T-Tx Unit itself or the Rx-L Unit, to an Internet server. Either the T-Tx Unit or the Rx-L Unit can accomplish the actual connection to the Internet. Either device can have a wired (E-Net, Fiber etc.) or wireless (cellular, 802.11, etc.) Internet connection. As an example, the T-Tx unit can use an 802.11 interface to a wireless router. Or, an Rx-L Unit can be placed right next to the physical Internet interface point (router, switch, modem, etc.), and have a wired connection to it.

The system can be configured so that an alarm indication is transmitted over the Internet, or by cellular telephone to a remote handheld unit such as a smartphone or tablet computer or to a remote computer. Software on the remote device could also log any alarm indications including the type of alarm, the date and time, and any other pertinent information.

Several drawings and illustrations have been presented to aid in understanding the present invention. One with skill in the art will realize that numerous changes and variations are possible without departing from the spirit of the invention. Each of these changes and variations is within the scope of the present invention.

I claim:

1. An alarm extension system comprising:

a trigger unit adapted to be located in proximity to an existing alarm device, said trigger unit configured to receive an alarm indication from said existing alarm device and transmit a wireless activation code;

a receiver unit remote from said trigger unit configured to receive said wireless activation code and produce a visual or audio indication of said alarm indication;

wherein the wireless activation code is a sequence of numbers chosen by a user.

2. The alarm extension system of claim 1 wherein said receiver unit is mounted on an exterior surface of a structure containing said existing alarm device.

3. The alarm extension system of claim 1 wherein said trigger unit is configured to only transmit said activation code when receiving an audio alarm indication from said existing alarm device exceeding a predetermined audio amplitude threshold.

4. The alarm extension system of claim 1 wherein said trigger unit is configured to only transmit said activation code when receiving an audio alarm indication from said existing alarm device within a predetermined audio frequency range.

5. The alarm extension system of claim 1 wherein said receiver unit is configured to attach to a conventional light fixture.

6. The alarm extension system of claim 5 wherein said receiver unit also includes a convention light fixture.

7. The alarm extension system of claim 5 wherein said receiver derives power from said convention light fixture.

8. The alarm extension system of claim 1 wherein said sequence of numbers is coded on a switch in the trigger unit and also coded on a switch in the receiver light unit.

9. The alarm extension system of claim 1 wherein said wireless activation code is transmitted by pulse-modulated RF.

10. A method of extending an alarm from a structure's interior to its exterior comprising:

providing a trigger unit located in said interior of the structure in proximity to an existing alarm system, said trigger unit adapted to receive an alarm indication from said existing alarm system and transmit a wireless activation code, wherein the wireless activation code is a sequence of numbers chosen by a user;

providing a receiver unit on said exterior of the structure adapted to receive said wireless alarm indication and produce a visual or audio indication of said alarm indication.

11. The method of claim 10 further comprising receiving at said trigger unit an audio alarm indication from said existing alarm system.

12. The method of claim 11 wherein said trigger unit filters said audio alarm indication to select one or more particular audio frequency bands.

13. The method of claim 11 wherein said trigger unit only transmits said wireless activation code when said audio alarm indication exceeds a predetermined amplitude.

14. The method of claim 10 further comprising providing an RF transmitter in said trigger unit and an RF receiver in said receiver unit cooperating to form a wireless RF link transmitting said wireless activation code from the trigger unit to the receiving unit.

15. The method of claim 10 wherein said trigger unit filters said audio alarm indication to require a predetermined time duration of the audio alarm indication.

16. An alarm extension system comprising:

a trigger unit adapted to be located in proximity to an existing alarm device, said trigger unit configured to receive an alarm indication from said existing alarm device and transmit a wireless activation code;

a receiver unit remote from said trigger unit configured to receive said wireless activation code and produce a visual or audio indication of said alarm indication; wherein the wireless activation code is a sequence of numbers chosen by a user;

a network interface unit in data communications with said trigger unit or said receiver unit configured to transmit said alarm indication over a network to a remote location.

17. The alarm extension system of claim 16 wherein said network is the Internet.

18. The alarm extension system of claim 16 wherein said network interface unit communicates wirelessly with said trigger unit or said receiver unit.

19. The alarm extension system of claim 16 configured to transmit said alarm indication over the network to a handheld device.

20. An alarm extension system comprising:

a trigger unit adapted to be located in proximity to an existing alarm device, said trigger unit configured to receive an alarm indication from said existing alarm device and transmit a wireless activation code;

a receiver unit remote from said trigger unit configured to receive said wireless activation code and produce a visual or audio indication of said alarm indication;

wherein the wireless activation code is a sequence of numbers, and wherein the trigger unit filters the audio alarm indication to require a predetermined time duration of the audio alarm indication.

21. The alarm extension system of claim 20 wherein the sequence of numbers is chosen by a user.

* * * * *